US011548694B1

(12) United States Patent
Allen et al.

(10) Patent No.: US 11,548,694 B1
(45) Date of Patent: Jan. 10, 2023

(54) LIQUID DISPENSER FOR A BOTTLE

(71) Applicant: Allen Brothers & Rosselot Inc., Goose Creek, SC (US)

(72) Inventors: Michael J. Allen, Goose Creek, SC (US); Jon T. Allen, North Charleston, SC (US); Lawrence J. Rosselot, North Charleston, SC (US)

(73) Assignee: Allen Brothers & Rosselot Inc., Goose Creek, SC (US)

( * ) Notice: Subject to any disclaimer, the term of this patent is extended or adjusted under 35 U.S.C. 154(b) by 0 days.

(21) Appl. No.: 17/183,726

(22) Filed: Feb. 24, 2021

Related U.S. Application Data

(63) Continuation of application No. 15/919,265, filed on Mar. 13, 2018, now Pat. No. 10,961,028.

(60) Provisional application No. 62/471,381, filed on Mar. 15, 2017.

(51) Int. Cl.
*B65D 47/18* (2006.01)
*B01L 3/02* (2006.01)

(52) U.S. Cl.
CPC ..... *B65D 47/18* (2013.01); *B01L 3/0272* (2013.01)

(58) Field of Classification Search
CPC ..... B67D 47/18; B01L 3/0272; B01L 2200/0615
See application file for complete search history.

(56) References Cited

U.S. PATENT DOCUMENTS

| | | | | |
|---|---|---|---|---|
| 2,744,661 | A | 5/1956 | Davis | |
| 3,007,608 | A | 11/1961 | Cox, Jr. | |
| 3,305,144 | A | 2/1967 | Beres | |
| 3,321,113 | A | 5/1967 | Conry | |
| 3,352,463 | A | 11/1967 | Berler | |
| 3,863,817 | A | 2/1975 | Speaker | |
| 4,002,168 | A | 1/1977 | Petterson | |
| 4,165,814 | A | 8/1979 | Seel | |
| 4,174,743 | A | 11/1979 | Beny | |
| 5,328,058 | A | 7/1994 | Leoncavallo | |
| 6,076,709 | A | 6/2000 | Wilner | |
| 6,736,802 | B1 | 5/2004 | Recanati | |
| 8,770,448 | B2 | 7/2014 | Wochele | |
| 9,394,089 | B2 | 7/2016 | Silvers et al. | |
| 9,428,374 | B2 | 8/2016 | Houck et al. | |
| 9,884,706 | B1 | 2/2018 | Skillin | |
| 10,961,028 | B1 | 3/2021 | Allen et al. | |
| 2006/0037972 | A1 | 2/2006 | Leiner | |
| 2007/0055208 | A1* | 3/2007 | Berger | A61F 9/0008 604/295 |
| 2007/0262096 | A1* | 11/2007 | Gaynes | A61F 9/0008 222/420 |

(Continued)

FOREIGN PATENT DOCUMENTS

| | | |
|---|---|---|
| JP | 2000025778 A | 1/2000 |
| WO | 2014192737 | 12/2014 |

OTHER PUBLICATIONS

Google.com English translation of JP 2000025778 (8 pages).
Google.com English translation of WO 2014192737 (13 pages).

*Primary Examiner* — J C Jacyna
(74) *Attorney, Agent, or Firm* — Thrive IP®; Jeremy M. Stipkala

(57) ABSTRACT

Liquid dispensers for bottles comprise a dispensing chamber having small portals at either end. Dropwise addition of flavoring or coloring liquids, such as vermouth or bitters, to alcoholic beverages using those liquid dispensers is also disclosed.

7 Claims, 7 Drawing Sheets

(56) References Cited

U.S. PATENT DOCUMENTS

| | | | | |
|---|---|---|---|---|
| 2010/0016814 | A1 | 1/2010 | Gokhale | |
| 2010/0044395 | A1* | 2/2010 | Webb | A61L 2/26 222/562 |
| 2010/0252585 | A1 | 10/2010 | Yui | |
| 2011/0036451 | A1 | 2/2011 | Maas | |
| 2011/0297703 | A1* | 12/2011 | Wilson | B65D 47/18 222/571 |
| 2013/0228596 | A1* | 9/2013 | Faulkner | B01L 3/0293 222/567 |
| 2015/0038925 | A1 | 2/2015 | Parunak | |
| 2015/0048123 | A1* | 2/2015 | Frank | B65D 47/06 222/478 |
| 2016/0176593 | A1 | 6/2016 | Stolle | |
| 2016/0236834 | A1 | 8/2016 | Erlhofer | |
| 2016/0354733 | A1 | 12/2016 | Chung | |
| 2018/0042766 | A1 | 2/2018 | Nagao | |

* cited by examiner

LIQUID DISPENSER FOR A BOTTLE

CROSS-REFERENCE TO RELATED APPLICATIONS

The present application is a continuation of and claims benefit of priority under 35 U.S.C. § 120 to U.S. Non-Provisional patent application Ser. No. 15/919,265, entitled, "LIQUID DISPENSER FORA BOTTLE," now U.S. Pat. No. 10,961,028 B1, issued Mar. 30, 2021, which in turn claims benefit of priority under 35 U.S.C. § 119(e) to U.S. Provisional Patent Application No. 62/471,381, entitled, "LIQUID DISPENSER FOR A BOTTLE," filed Mar. 15, 2017; the disclosures of application Ser. Nos. 15/919,265 and 62/471,381 are incorporated herein by reference in their entirety.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to technology for dispensing liquid from a bottle, for example, in the form of uniform droplets.

BACKGROUND OF THE INVENTION

Certain alcoholic beverages require a small and precise amount of flavoring or coloring liquids. For example, a martini requires a small amount of vermouth no more than about one fluid ounce. Dry martinis measure vermouth by the drop or dash, and extra dry martinis require just a single drop. Similarly, Manhattans call for small volumes of vermouth and a dash of bitters; and numerous other beverages require mere drops and dashes of flavoring or coloring liquids.

A difficulty emerges when those liquids such as vermouth and bitters are stored in bottles with relatively wide mouths. Even with conventional pourers, experienced bartenders find it difficult to consistently deliver a precise amount of a flavoring liquid to a cocktail shaker or a glass. That is a problem, because sophisticated consumers can taste the difference between, for example, a properly-made martini and its dry and extra dry editions. Moreover, conventional technology prolongs the making of these beverages. One unfortunate result of the difficulty and delay associated with making beverages requiring precise amounts of flavoring or coloring liquids is that their popularity is declining. Bars and restaurants, however, desire to sell such beverages, since they command a premium price over beer and wine. A better technology for dispensing small and precise amounts of flavoring or coloring liquids is required.

SUMMARY OF THE INVENTION

Unexpectedly, and after considerable research, Applicant has invented a technology for dispensing small and precise volumes of liquids. With this technology, drops of a flavoring or coloring liquid such as vermouth or bitters can be added to a cocktail shaker or a glass. Similarly, whenever a small volume of a liquid must be dispensed from a vessel such as a bottle containing a large volume of that liquid, Applicant's technology can be employed.

Accordingly, some embodiments of the present invention provide liquid dispensers for a bottle, one such dispenser comprising a dispensing chamber having a receiving end opposite a dispensing end, the receiving end comprising a receiving portal, and the dispensing end comprising a dispensing portal.

Other embodiments relate to methods of making a liquid dispenser for a bottle, one such method comprising:

constructing a dispensing chamber comprising a receiving end opposite a dispensing end;

establishing a receiving portal in the receiving end; and establishing a dispensing portal in the dispensing end.

Still other embodiments relate to methods of dispensing a liquid from a bottle, one such method comprising:

obtaining a liquid dispenser comprising a dispensing chamber having a receiving end opposite a dispensing end, wherein the receiving end comprises a receiving portal, and the dispensing end comprises a dispensing portal;

introducing the liquid to be dispensed into the dispensing chamber through the receiving portal; and dispensing the liquid from the dispensing chamber through the dispensing portal, wherein the liquid emerging from the dispensing portal is in the form of drops.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
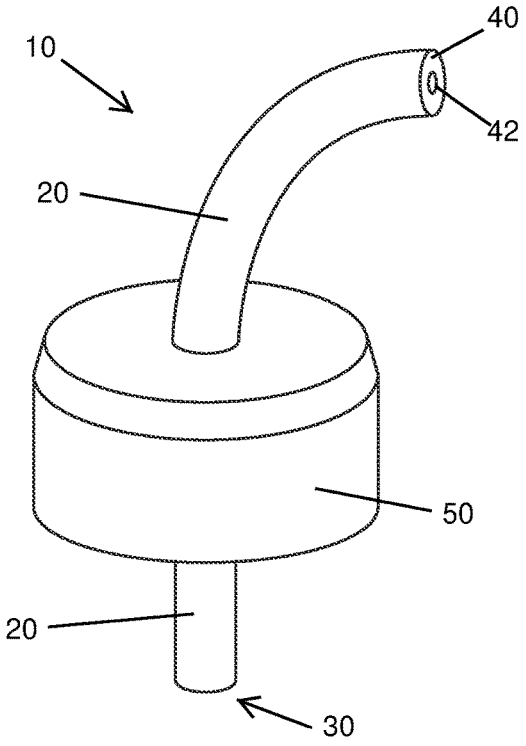
FIG. 1 depicts one embodiment of the invention comprising a liquid dispenser for a bottle, in a right perspective view.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Where ever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

As stated herein, certain embodiments of the present invention relate to a liquid dispenser fora bottle, comprising a dispensing chamber having a receiving end opposite a dispensing end, the receiving end comprising a receiving portal, and the dispensing end comprising a dispensing portal. In some cases, the dispensing chamber can be thought of as a closed, hollow chamber of any suitable shape and dimensions. Certain instances provide a dispensing chamber that is tubular, such as, for example, cylindrical. Other instances provide a cylindrical dispensing chamber that has an arcuate cylindrical shape. As illustrated in the figures, an arcuate cylindrical shape can be described as a curved tube. The dispensing chamber can have any suitable cross sectional shape, such as, for example, circular, oval, triangle, square, rectangular, polygonal, or any irregular, decorative shape. Any suitable volume can be employed for the dispensing chamber, such as, for example, less than 1 mL, less than 2 mL, less than 3 mL, less than 4 mL, less than 5 mL, or less than 10 mL. For another example, the dispensing chamber can have a volume of at least 1 mL, at least 2 mL, at least 3 mm, at least 4 mm, at least 5 mL, or at least 10 mL.

The liquid dispenser has a receiving end opposite a dispensing end, and a receiving portal and a dispensing portal that together control the flow of liquid to be dispensed from the dispensing chamber. In operation, the liquid dispenser is positioned in the neck of a bottle of a liquid to be dispensed, for example, and the bottle is tilted so that the liquid moves into the neck of the bottle. The liquid encounters the dispensing chamber, and gravity causes the liquid to flow through the receiving portal into the dispensing chamber. Gravity further draws the liquid through the dispensing portal, where the liquid is dispensed in the form of drops, in some cases.

The dispensing portal in many cases has a small dimension to control drop formation as gravity draws liquid from the dispensing chamber. The exact dimensions of the dispensing portal are not critical; any suitable dimensions can be used. Also, the receiving portal also can have a small dimension to control gas and liquid exchange at the receiving end as gravity draws liquid from the dispensing chamber at the dispensing end. The exact dimensions of the receiving portal are not critical; any suitable dimensions can be used. In some cases, the dispensing portal is smaller in at least one dimension, relative to the receiving portal. The dispensing portal and the receiving portal can have any independently-selected shapes, such as, for example, circular, triangular, square, rectangular, polygonal, or irregular. Some instances provide a dispensing portal that is circular. Other instances provide a receiving portal is circular.

Any suitable dimensions can be employed for the dispensing portal. In certain embodiments, the dimensions of the dispensing portal are chosen so that the desired liquid form drops as it emerges under the force of gravity from the dispensing portal. For example, a circular dispensing portal can have a diameter of at least 0.1 mm, at least 0.2 mm, at least 0.3 mm, at least 0.4 mm, at least 0.5 mm, at least 0.6 mm, at least 0.7 mm, at least 0.8 mm, at least 0.9 mm, or at least 1.0 mm. For another example, a circular dispensing portal can have a diameter of no more than 1.0 mm, no more than 1.5 mm, no more than 2.0 mm, no more than 2.5 mm, no more than 3.0 mm, no more than 3.5 mm, no more than 4.0 mm, no more than 4.5 mm, or no more than 5.0 mm. In yet another example, a dispensing portal can have a diameter of about 0.6 mm. If the dispensing portal has a shape other than circular, similar dimensions can be used.

Any suitable dimensions can be employed for the receiving portal. Some embodiments allow for the dimensions of the receiving portal to be chosen so that the liquid emerges from the dispensing portal in the form of drops. For example, a circular receiving portal can have a diameter of at least 0.15 mm, at least 0.2 mm, at least 0.3 mm, at least 0.4 mm, at least 0.5 mm, at least 0.6 mm, at least 0.7 mm, at least 0.8 mm, at least 0.9 mm, at least 1.0 mm, at least 1.1 mm, at least 1.2 mm, at least 1.3 mm, at least 1.4 mm, or at least 1.5 mm. In another example, a circular receiving portal can have a diameter of no more than 1.0 mm, no more than 1.5 mm, no more than 2.0 mm, no more than 2.5 mm, no more than 3.0 mm, no more than 3.5 mm, no more than 4.0 mm, no more than 4.5 mm, or no more than 5.0 mm. In yet another example, the receiving portal has a diameter of about 1.2 mm. If the receiving portal has a shape other than circular, similar dimensions can be used.

The dispensing end and the receiving end independently can have any suitable shapes. For example, the dispensing end can have a thickness that is the same as, greater than, or less than the dimension such as diameter of the dispensing portal. The dispensing portal can be straight, as in a right cylinder, or a rectangle, or it can have a conical profile oriented either outwardly (see FIG. 10) or inwardly (see FIG. 11). Similarly, the dispensing portal can be pyramidal, with three, four, five, or more sides, and oriented outwardly or inwardly. The exterior surface of the dispensing end can be flat, concave, or convex. Compare, for example, FIGS. 9-11 with FIGS. 12-13. These features can be used alone or in combination where possible.

Any suitable means can be used to position the dispensing chamber in the neck of a vessel such as a bottle. In some cases, a liquid dispenser of the present invention comprises a bottle cap portion supporting the dispensing chamber, the bottle cap portion adapted to maintain the liquid dispenser in the neck of the bottle. Optionally, one or more supporting fins reinforce and stabilize the dispensing chamber relative to the bottle cap portion. The supporting fin or supporting fins, and indeed any portion of the liquid dispenser, can further comprise a letter, a logo, an image, or any decorative feature that may be desired. In other cases, one or more merely-decorative fins or other pieces of rigid or semi-rigid material can extend from the dispensing chamber, the bottle cap portion, or both, as desired.

The liquid dispenser can be designed or adapted to control the flow of liquid from inside the vessel such as a bottle by any suitable means. With the liquid dispenser positioned in the neck of a bottle, for example, the bottle is tilted so the liquid contacts the receiving end of the dispensing chamber, and enters through the receiving portal. Care must be taken so that the liquid in the bottle does not escape around the liquid dispenser, spilling the liquid. The neck of the bottle can be sealed by any suitable means so that the liquid leaves the bottle only through the dispensing chamber. For example, the dispensing chamber can be adapted to engage a proxy cork that can sealingly engage a neck of the bottle. In other words, a proxy cork comprising flexible discs can fit around the dispensing chamber near the receiving end, thereby sealing the neck of the bottle except for the receiving port. In one alternative, the liquid dispenser further comprises a proxy cork portion proximal to the receiving end, wherein the proxy cork portion is adapted to sealingly engage a neck of the bottle. In that alternative, the proxy cork portion forms part of the liquid dispenser.

In certain instances of the present invention, the dispensing end has one or more structural features that reduce unwanted drips from the dispensing portal. Any suitable structural features can appear as a drip catcher on the dispensing end proximal to the dispensing portal. For example, a lip or ring on the exterior of the dispensing end proximal to the dispensing portal can catch unwanted drips before they roll or fall off of the dispensing end after the liquid is dispensed. For another example, structure can appear inside the dispensing end that limits the formation of unwanted drips from the dispensing portal.

Any suitable material or materials can be a used alone or in combination to form the liquid dispensers of the present invention. In certain instances, a liquid dispenser has a dispensing chamber that comprises polyethylene, polypropylene, polyurethane, polyetheretherketone (PEEK), polystyrene, polytetrafluoroethylene, glass, stainless steel, aluminum, or a combination thereof. The bottle cap portion also can comprise one or more of those materials, independently of what the dispensing chamber comprises. Where present, the proxy cork can comprise any suitable material, such as, for example, polyethylene, polypropylene, polyurethane, polyetheretherketone (PEEK), polystyrene, polytetrafluoroethylene, glass, stainless steel, or aluminum, in addition to natural or synthetic rubbers. Each of those materials can be used in the proxy cork alone or in combination.

Further embodiments of the present invention relate to methods of making a liquid dispenser for a bottle, such as any of those described herein, one such method comprising:

constructing a dispensing chamber comprising a receiving end opposite a dispensing end;

establishing a receiving portal in the receiving end; and establishing a dispensing portal in the dispensing end.

Any suitable processes can be used to construct a dispensing chamber. For example, when the dispensing chamber comprises one or more polymers, the constructing may comprise blow molding, injection molding, extrusion molding, or a combination thereof. If glass is used, glassblowing and molding techniques can be used. Casting, milling, and welding can be used alone or in combination when the dispensing chamber comprises a metal such as stainless steel or aluminum.

The receiving portal and the dispensing portal can be formed in any suitable manner. In some cases, the mold or molds used to form the dispensing chamber account for the formation of those portals. In other cases, the receiving portal and/or the dispensing portal can be cut or drilled from the receiving end and the dispensing end, respectively.

Of course, applicant has also invented methods of dispensing liquids, in particular, when a relatively small and precise volume of liquid is needed to be dispensed from a vessel such as a bottle containing a relatively large volume of liquid. Accordingly, yet additional embodiments of the present invention relate to methods of dispensing a liquid from a bottle, one such method comprising:

obtaining a liquid dispenser comprising a dispensing chamber having a receiving end opposite a dispensing end, wherein the receiving end comprises a receiving portal, and the dispensing end comprises a dispensing portal;

introducing the liquid to be dispensed into the dispensing chamber through the receiving portal; and dispensing the liquid from the dispensing chamber through the dispensing portal, wherein the liquid emerging from the dispensing portal is in the form of drops.

Any suitable liquid dispenser can be used in such methods, such as, for example the liquid dispensers as described herein. In addition, any suitable liquid can be dispensed with a liquid dispenser of the present invention. Vermouth, bitters, grenadine, falernum, lemon juice, lime juice, hot sauces, pickle juice, olive brine, and the like may be mentioned.

DETAILED DESCRIPTION OF THE DRAWINGS

Further embodiments of the present invention can be described by reference to the accompanying drawings.

FIG. 1 depicts one embodiment of the invention comprising a liquid dispenser for a bottle, in a right perspective view. Liquid dispenser 10 comprises a dispensing chamber 20 having a receiving end 30 opposite a dispensing end 40. Dispensing chamber 20 is hollow between the receiving end 30 and the dispensing end 40, so that liquid to be dispensed can enter the dispensing chamber 20. The dispensing end 40 includes a dispensing portal 42; receiving end 30 comprises a receiving portal (not visible). Dispensing portal 42 (and the not visible receiving portal) can have any independently-chosen suitable shape. Dispensing portal 42 is circular. Liquid dispenser 10 further comprises a bottle cap portion 50 supporting the dispensing chamber 20. Bottle cap portion 50 is adapted to maintain the liquid dispenser 10 in a neck of a bottle (not shown). As can be appreciated from FIG. 1, dispensing chamber 20 comprises an arcuate cylindrical shape. From the receiving end 30 to the bottle cap portion 50, dispensing chamber 20 is a straight cylinder. Above bottle cap portion 50, dispensing chamber 20 comprises a curved cylinder.

Figure 2:
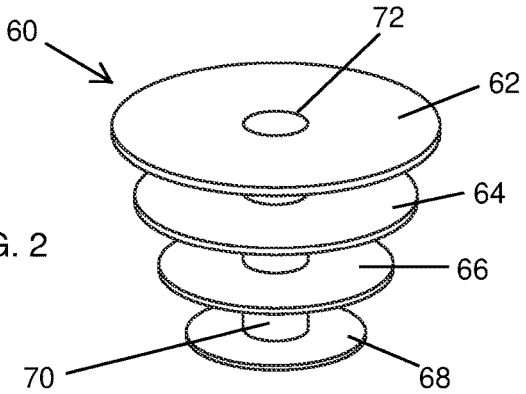
FIG. 2 depicts an embodiment of a proxy cork.

FIG. 2 depicts an embodiment of a proxy cork. Proxy cork 60 comprises a central tube 70 having an upper opening 72 and a plurality of flexible discs 62, 64, 66, and 68 attached to central tube 70 such that the proxy cork 60 is adapted to sealingly engage a neck of a bottle (not shown). Upper opening 72 can have any suitable shape such as, for example, circular, oval, polygonal, or any other shape (see, e.g., FIG. 15 for another suitable shape). Upper opening 72 can be dimensioned to slidingly engage dispensing chamber 20 at receiving end 30 of liquid dispenser 10, for example. When so engaged, proxy cork 60 could sealingly engage the interior of a neck of a bottle (not shown), and allow liquid in the bottle to pass into receiving chamber 20 without otherwise spilling out of the neck of the bottle.

Figure 3:
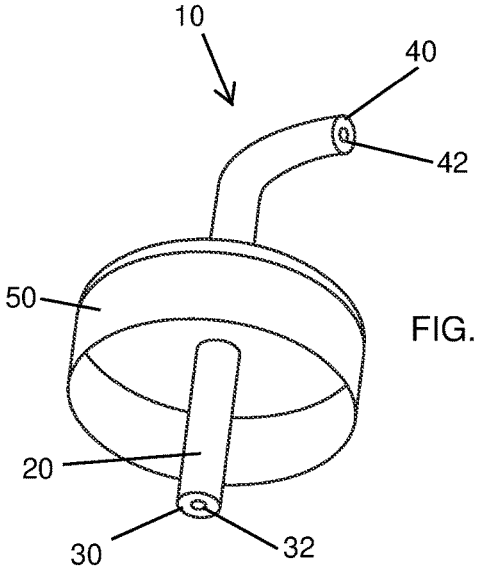
FIG. 3 provides a lower perspective view of the liquid dispenser shown in FIG. 1.

FIG. 3 provides a lower perspective view of the liquid dispenser 10 shown in FIG. 1. From this perspective, we see that receiving end 30 comprises receiving portal 32. In some embodiments, dispensing portal 42 is smaller in at least one dimension, relative to receiving portal 32.

Figure 4:
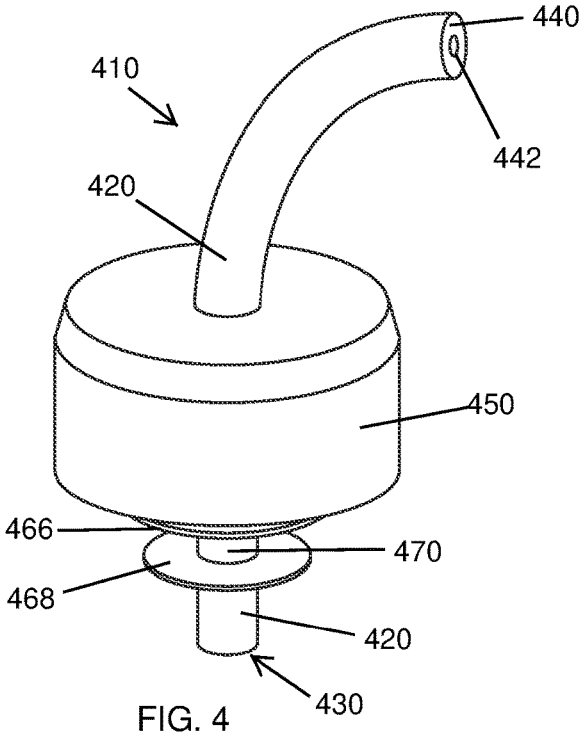
FIG. 4 provides a right perspective view of a liquid dispenser for a bottle further comprising a proxy cork portion proximal to the receiving end.

FIG. 4 provides a right perspective view of a liquid dispenser for a bottle further comprising a proxy cork portion proximal to the receiving end. Liquid dispenser 410 comprises a dispensing chamber 420 having a receiving end 430 opposite a dispensing end 440. Dispensing chamber 420 is hollow between the receiving end 430 and the dispensing end 440, so that liquid to be dispensed can enter the dispensing chamber 420. The dispensing end 440 includes a dispensing portal 442; receiving end 430 comprises a receiving portal (not visible). Liquid dispenser 410 further comprises a bottle cap portion 450 supporting the dispensing chamber 420. Bottle cap portion 450 is adapted to maintain the liquid dispenser 410 in a neck of a bottle (not shown). As can be appreciated from FIG. 4, dispensing chamber 420 comprises an arcuate cylindrical shape. From the receiving end 430 to the bottle cap portion 450, dispensing chamber 420 is a straight cylinder. Above bottle cap portion 450, dispensing chamber 420 comprises a curved cylinder. Liquid dispenser 410 further comprises a proxy cork portion 460 proximal to the receiving end 430. The proxy cork portion 460 is adapted to sealingly engage the inside of a neck of a bottle (not shown), so that when the bottle is tipped, the liquid dispenser 410 does not fall out of the neck, nor spill liquid from the bottle. Flexible discs 466, 468 attached to central tube 470 of the proxy cork portion 460 are visible in FIG. 4.

Figure 5:
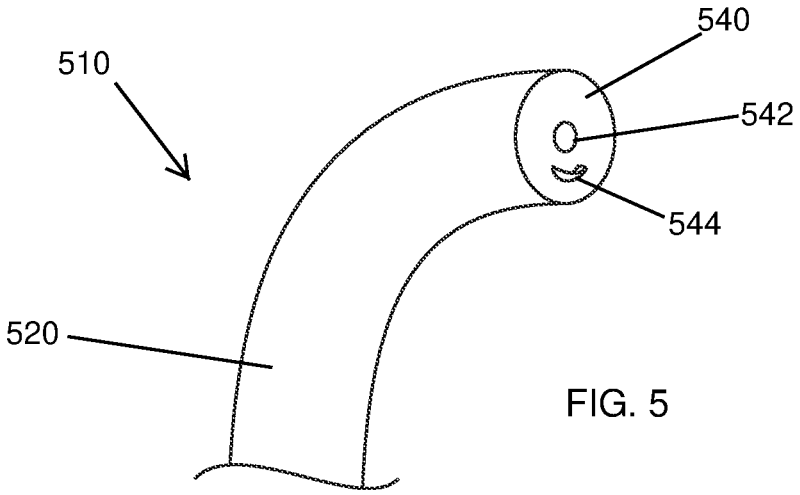
FIG. 5 provides a partial right perspective view of a liquid dispenser comprising a drip catcher.

FIG. 5 provides a partial right perspective view of a liquid dispenser comprising a drip catcher. Liquid dispenser 510 comprises a dispensing chamber 520, having a dispensing end 540 which has a dispensing portal 542 and a drip catcher 544. Other portions of liquid dispenser 510 are not shown for simplicity. The drip catcher 544 in this embodiment is in the form of a curved tab positioned near the dispensing portal 542 to control unintended drops or spillage from the dispensing portal 542 once the desired number of drops of liquid have been dispensed from liquid dispenser 510.

Figure 6:
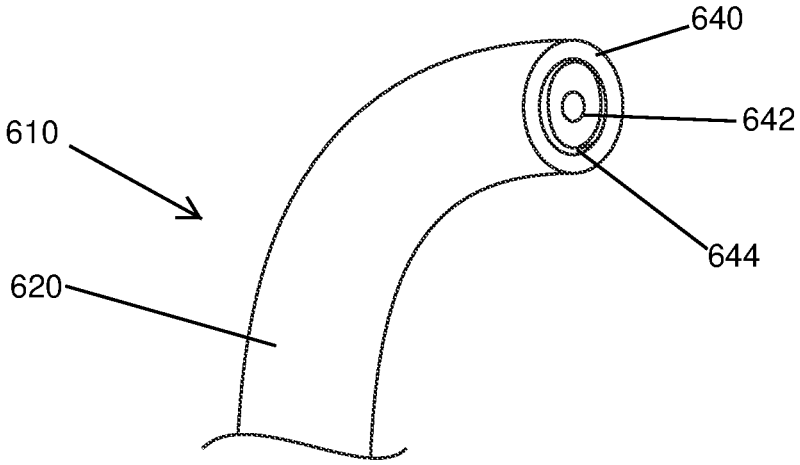
FIG. 6 provides a partial right perspective view of a liquid dispenser comprising a drip catcher in the form of a rim around the dispensing portal.

FIG. 6 provides a partial right perspective view of another liquid dispenser comprising a drip catcher in the form of a rim around the dispensing portal. Liquid dispenser 610 comprises a dispensing chamber 620, having a dispensing end 640 which has a dispensing portal 642 and a drip catcher 644. Other portions of liquid dispenser 610 are not shown for simplicity. The drip catcher 644 in this embodiment is in the form of a raised circular lip positioned around the dispensing portal 642 to control unintended drops or spillage from the dispensing portal 642 once a desired number of drops of liquid have been dispensed from liquid dispenser 610.

Figure 7:
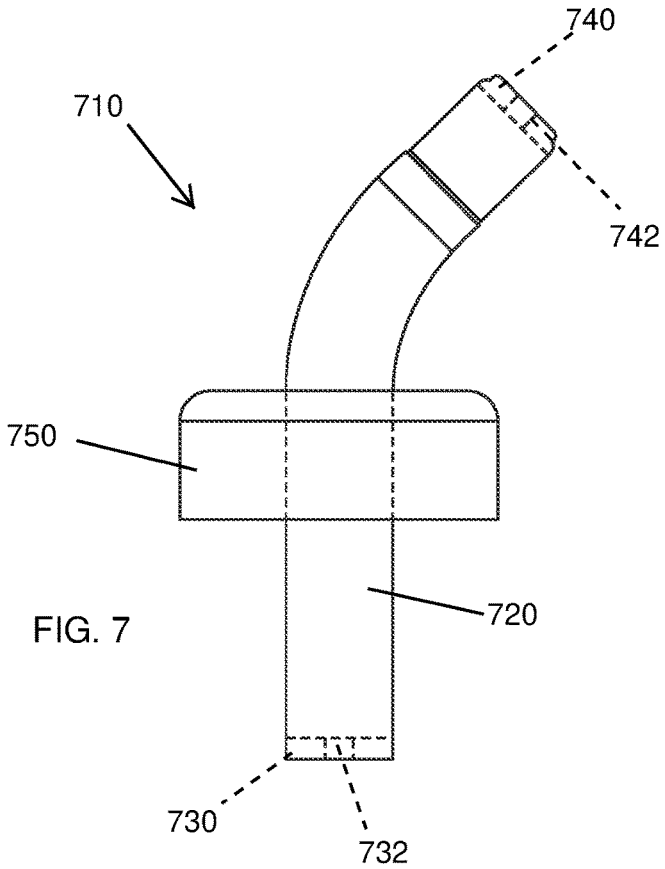
FIG. 7 provides a right elevation view of a liquid dispenser depicting certain interior structure.

FIG. 7 provides a right elevation view of a liquid dispenser depicting certain interior structure. Liquid dispenser 710 comprises a dispensing chamber 720 having a receiving end 730 opposite a dispensing end 740. Dispensing chamber 720 is hollow between the receiving end 730 and the dispensing end 740, so that liquid to be dispensed can enter the dispensing chamber 720. The dispensing end 740 includes a dispensing portal 742; receiving end 730 comprises a receiving portal 732. Dispensing portal 742 and receiving portal 732 can have any independently-chosen suitable shape. Dispensing portal 742 is circular. Receiving portal 732 is circular. In some embodiments, dispensing portal 742 is smaller in at least one dimension, relative to receiving portal 732. Liquid dispenser 710 further comprises a bottle cap portion 750 supporting the dispensing chamber 720. Bottle cap portion 750 is adapted to maintain the liquid dispenser 710 in a neck of a bottle (not shown). As can be appreciated from FIG. 7, dispensing chamber 720 comprises an arcuate cylindrical shape. From the receiving end 730 to the bottle cap portion 750, dispensing chamber 720 is a straight cylinder. Above bottle cap portion 750, dispensing chamber 720 comprises a curved cylinder. FIG. 7 also shows that liquid dispenser 710 comprises no tube or separate structure for air exchange or pressure equilibrating with the interior of the bottle (not shown) other than receiving portal 732 and dispensing portal 742. Accordingly, some embodiments of the present invention comprise no other structure for equilibrating pressure.

Figure 8:
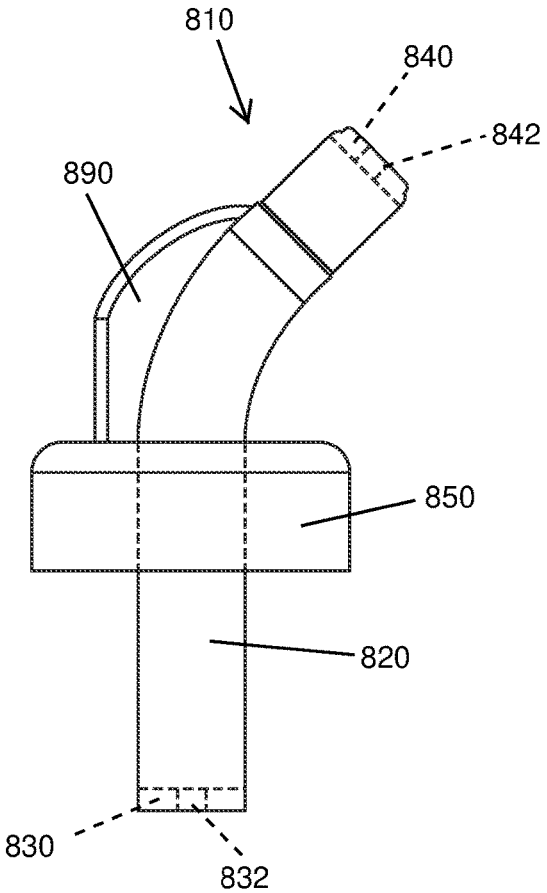
FIG. 8 provides a right elevation view of another liquid dispenser depicting certain interior structure, also showing a supporting fin.

FIG. 8 provides a right elevation view of another liquid dispenser depicting certain interior structure, also showing a supporting fin. Liquid dispenser 810 comprises a dispensing chamber 820 having a receiving end 830 opposite a dispensing end 840. Dispensing chamber 820 is hollow between the receiving end 830 and the dispensing end 840, so that liquid to be dispensed can enter the dispensing chamber 820. The dispensing end 840 includes a dispensing portal 842; receiving end 830 comprises a receiving portal 832. Dispensing portal 842 and receiving portal 832 can have any independently-chosen suitable shape. Dispensing portal 842 is circular. Receiving portal 832 is circular. In some embodiments, dispensing portal 842 is smaller in at least one dimension, relative to receiving portal 832. Liquid dispenser 810 further comprises a bottle cap portion 850 supporting the dispensing chamber. Bottle cap portion 850 is adapted to maintain the liquid dispenser 810 in a neck of a bottle (not shown). As can be appreciated from FIG. 8, dispensing chamber 820 comprises an arcuate cylindrical shape. From the receiving end 830 to the bottle cap portion 850, dispensing chamber 820 is a straight cylinder. Above bottle cap portion 850, dispensing chamber 820 comprises a curved cylinder. Supporting fin 890 reinforces and stabilizes dispensing chamber 820 relative to bottle cap portion 850.

Figure 9:
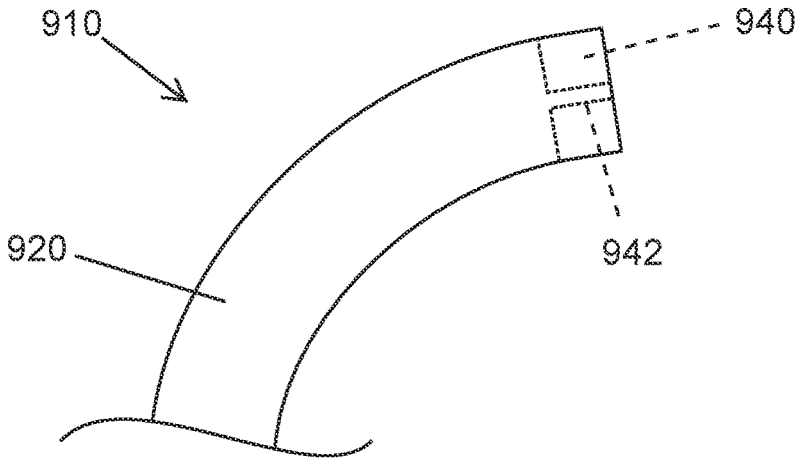
FIG. 9 provides a partial right elevation view of a liquid dispenser depicting certain interior structure.

FIG. 9 provides a partial right elevation view of a liquid dispenser depicting certain interior structure. Liquid dispenser 910 comprises a dispensing chamber 920, having a dispensing end 940 which has a dispensing portal 942. Here, the thickness of dispensing end 940 is significantly greater than the diameter of dispensing portal 942. In general, the ratio of the thickness of a dispensing end to the width such as diameter of a dispensing portal can be any suitable ratio. In some cases, the ratio of that thickness to that width can be 0.1, 0.5, 1, 2, 3, 4, 5, or 10 times. In certain instances, a thicker dispensing end relative to the width of the dispensing portal can assist in preventing unwanted drips. When the bottle (not shown) is returned to an upright position, gravity will pull liquid from the dispensing chamber 920, which in turn will pull a slight vacuum on dispensing portal 942, reducing unwanted drips at dispensing end 940.

Figure 10:
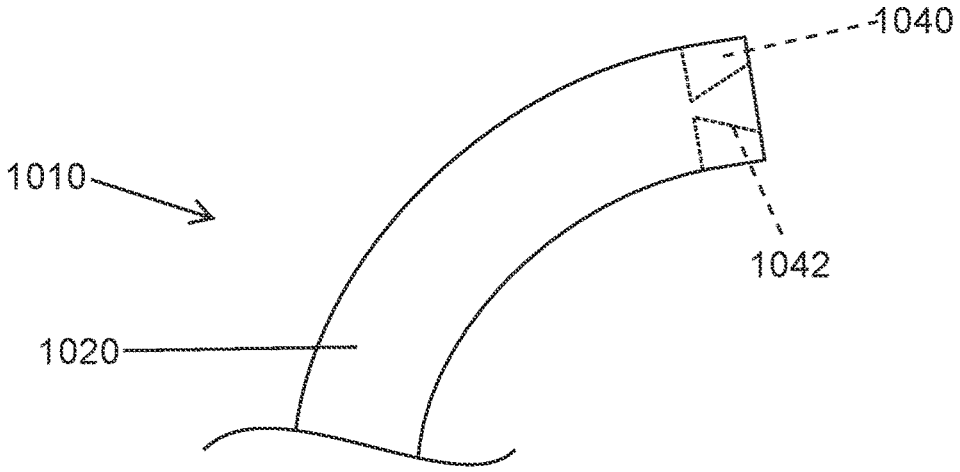
FIG. 10 provides a partial right elevation view of a liquid dispenser depicting certain interior structure.

FIG. 10 provides a partial right elevation view of a liquid dispenser depicting certain interior structure. Liquid dispenser 1010 comprises a dispensing chamber 1020, having a dispensing end 1040 which has a dispensing portal 1042. Dispensing portal 1042 has a cone-shaped profile, and seen in FIG. 10.

Figure 11:
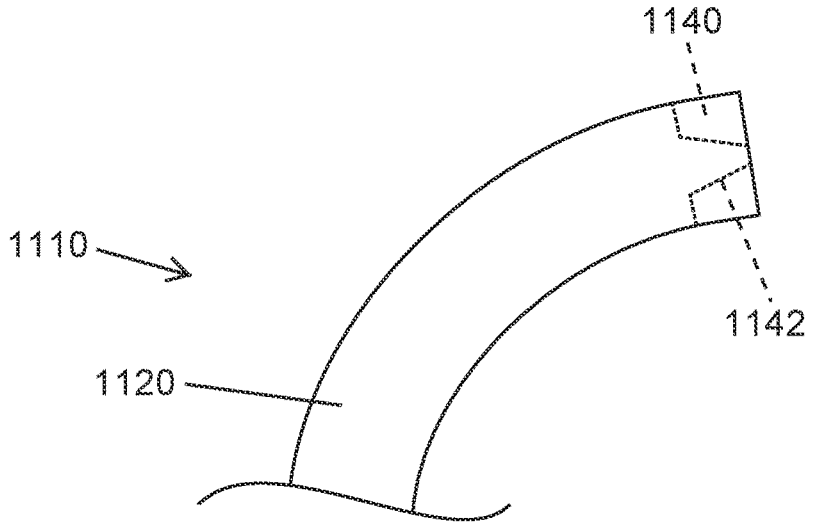
FIG. 11 provides a partial right elevation view of a liquid dispenser depicting certain interior structure.

FIG. 11 provides a partial right elevation view of a liquid dispenser depicting certain interior structure. Liquid dispenser 1110 comprises a dispensing chamber 1120, having a dispensing end 1140 which has a dispensing portal 1142. Dispensing portal 1142 has an inverted cone-shaped profile, as seen in FIG. 11.

Figure 12:
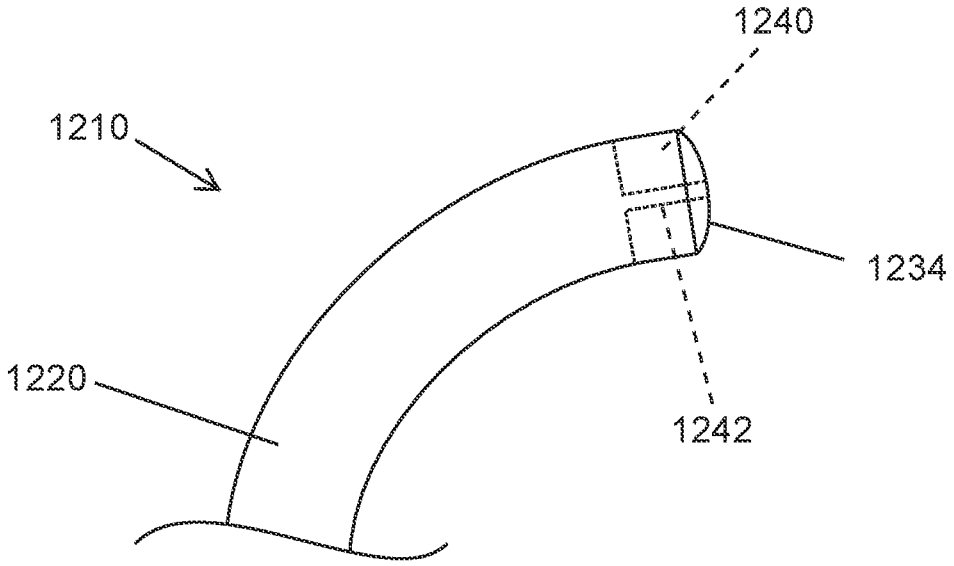
FIG. 12 provides a partial right elevation view of a liquid dispenser depicting certain interior structure.

FIG. 12 provides a partial right elevation view of a liquid dispenser depicting certain interior structure. Liquid dispenser 1210 comprises a dispensing chamber 1220, having a dispensing end 1240 which has a dispensing portal 1242. Here, dispensing end 1240 further comprises convex surface 1234.

Figure 13:
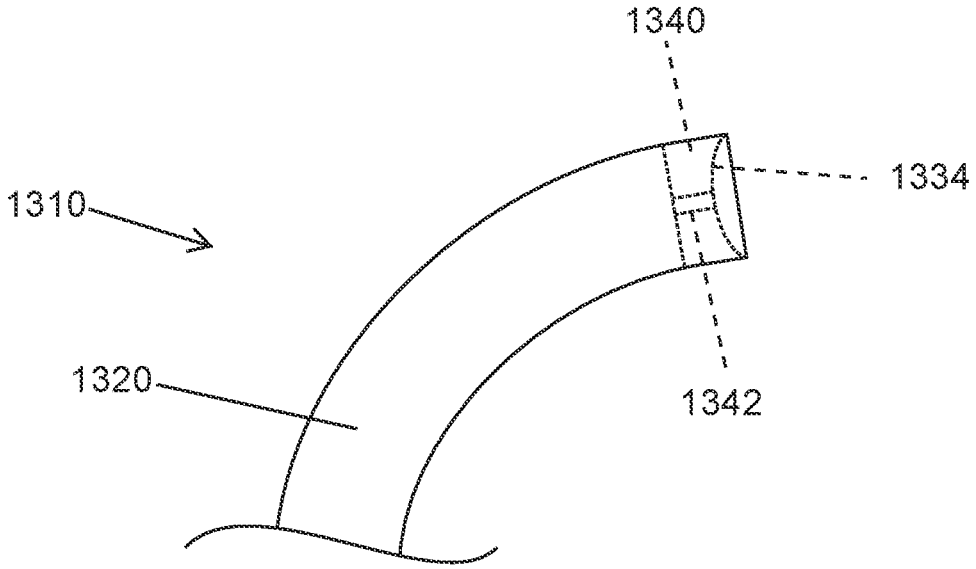
FIG. 13 provides a partial right elevation view of a liquid dispenser depicting certain interior structure.

FIG. 13 provides a partial right elevation view of a liquid dispenser depicting certain interior structure. Liquid dispenser 1310 comprises a dispensing chamber 1320, having a dispensing end 1340 which has a dispensing portal 1342. Here, dispensing end 1340 further comprises concave surface 1334.

Figure 14:
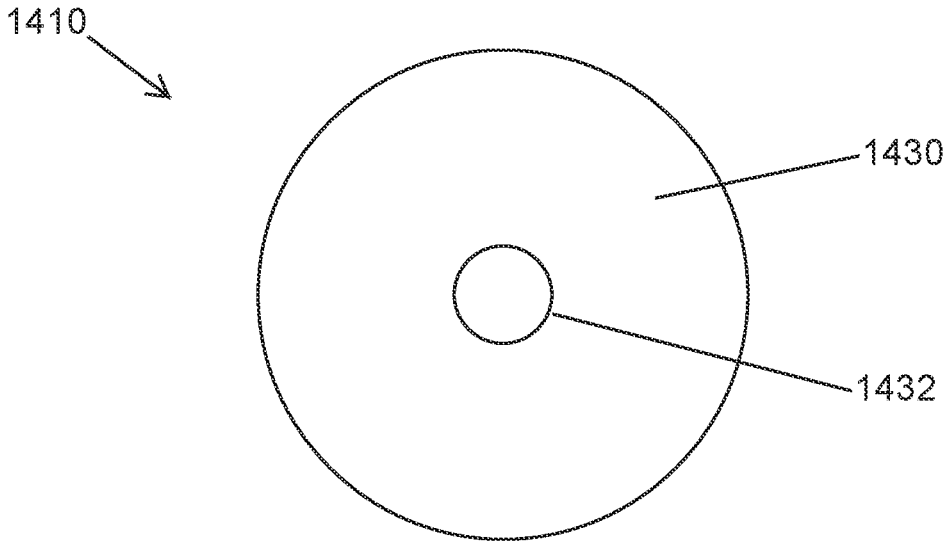
FIG. 14 depicts the receiving end of a liquid dispenser.

FIG. 14 depicts the receiving end of a liquid dispenser, looking end on. The receiving end of a liquid dispenser can have any suitable shape. In FIG. 14, liquid dispenser 1410 has a receiving end 1430 that is circular. Receiving portal 1432 is also circular.

Figure 15:
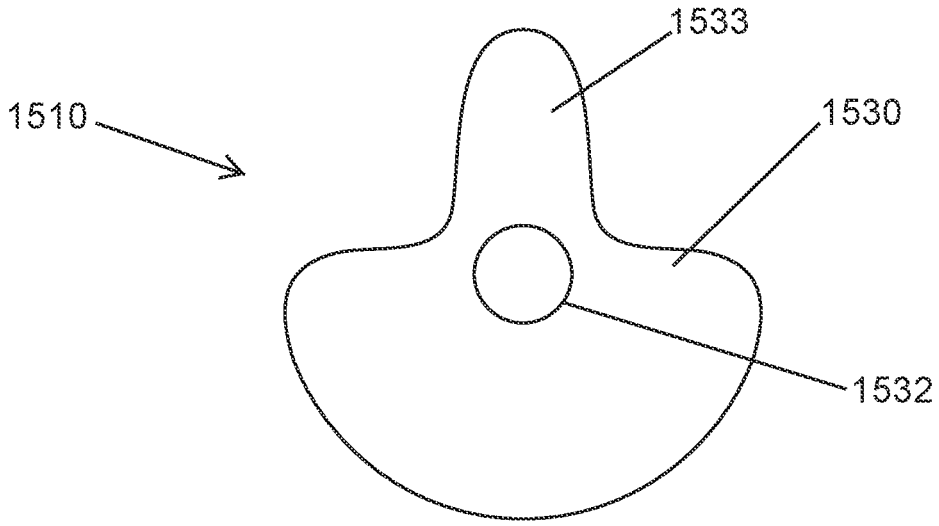
FIG. 15 depicts the receiving end of another liquid dispenser.
Figure 16:
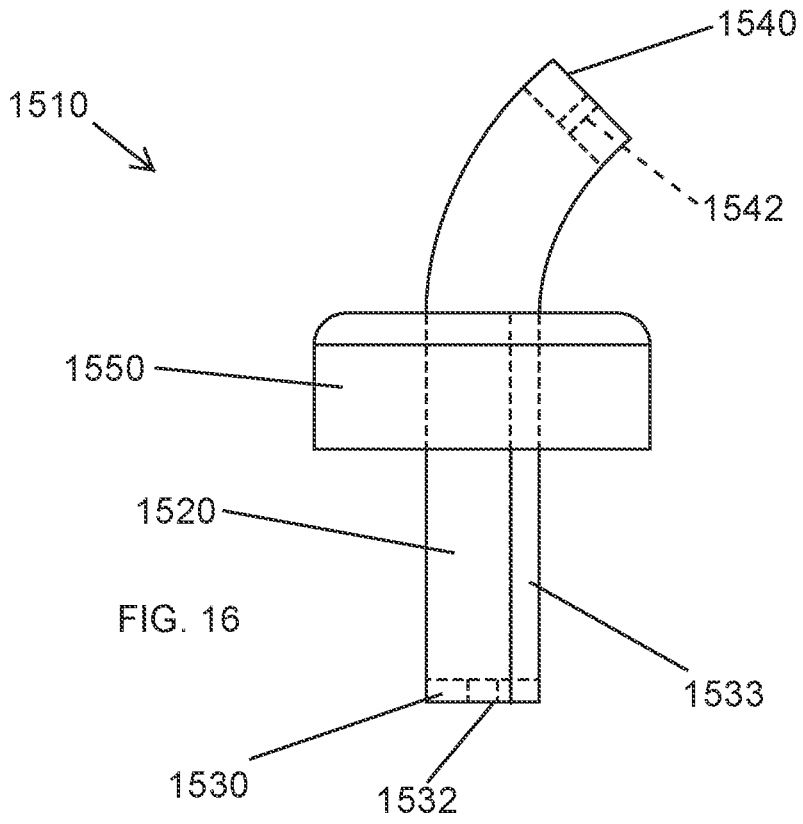
FIG. 16 provides a right elevation view of the liquid dispenser illustrated in FIG. 15.
Figure 17:
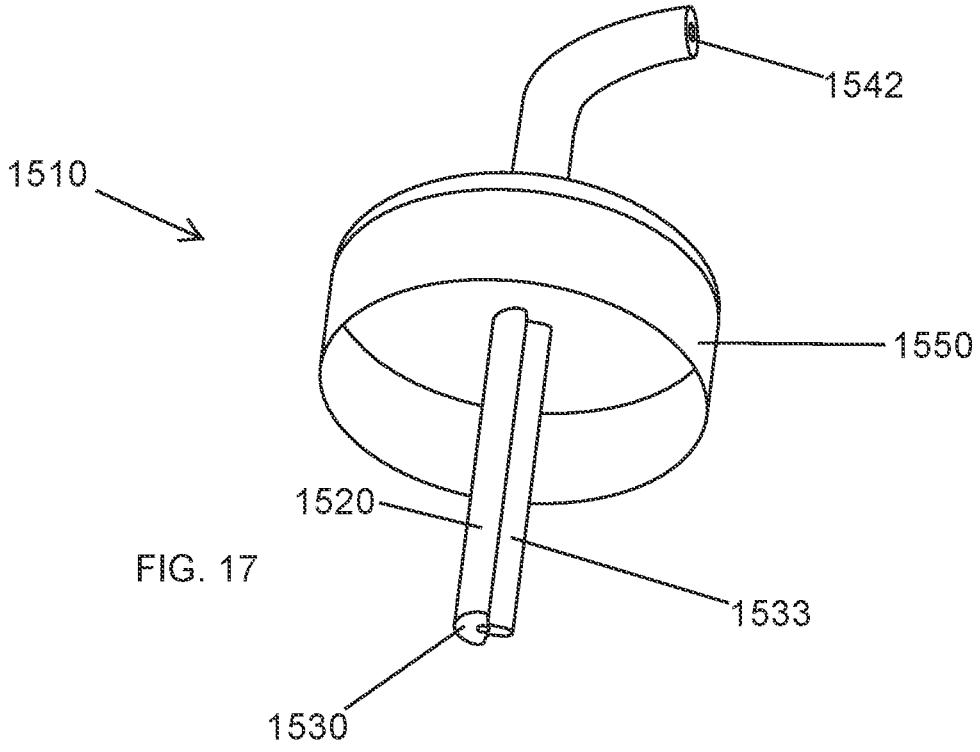
FIG. 17 provides a perspective view from below of the liquid dispenser illustrated in FIGS. 15 and 16.

FIG. 15 depicts the receiving end of another liquid dispenser, and FIGS. 16 and 17 provide further views of that liquid dispenser. Liquid dispenser 1510 comprises a dispensing chamber 1520 having a receiving end 1530 opposite a dispensing end 1540. Dispensing chamber 1520 is hollow between the receiving end 1530 and the dispensing end 1540, so that liquid to be dispensed can enter the dispensing chamber 1520. The dispensing end 1540 includes a dispensing portal 1542; receiving end 1530 comprises a receiving portal. Dispensing portal 1542 and receiving portal 1532 can have any independently-chosen suitable shapes. Receiving portal 1532 is circular. Dispensing portal 1542 is circular. Liquid dispenser 10 further comprises a bottle cap portion 1550 supporting the dispensing chamber 1520. Bottle cap portion 1550 is adapted to maintain the liquid dispenser 1510 in a neck of a bottle (not shown). As can be appreciated from FIGS. 16 and 17, dispensing chamber 1520 comprises an arcuate cylindrical shape. From the receiving end 1530 to the bottle cap portion 1550, dispensing chamber 1520 is straight, and comprises a ridge 1533 adapted to accommodate commercially-available proxy corks (not shown). Certain commercially-available proxy corks have an upper opening and central tube (compare FIG. 2, items 72 and 70, respectively) that have a cross-sectional shape substantially conforming to the profile of receiving end 1530 as shown in FIG. 15. In this way, the receiving end 1530 is adapted to engage those commercially-available proxy corks to sealingly engage a neck of the bottle. Above bottle cap portion 1550, dispensing chamber 1520 comprises a curved cylinder. Accordingly, in some embodiments of the present invention, the dispensing chamber further comprises a ridge adapted to accommodate commercially-available proxy corks.

EXAMPLES

Example 1—Liquid Dispenser

A liquid dispenser similar in appearance to liquid dispenser 10 as shown in FIGS. 1 and 3 is made in the following manner. High density polypropylene is melted and poured into two symmetrical half molds and allowed to cool. The cooled articles are released from the molds and sandwiched together to form the liquid dispenser 10 having dispensing chamber 20 and bottle cap portion 50. The two halves are fused together, and dispensing portal 42 is drilled into dispensing end 40. Receiving portal 32 is drilled into receiving end 30. Dispensing portal 42 has a diameter of 0.6 mm; receiving portal 32 has a diameter of 1.2 mm. The liquid dispenser 10 is obtained.

Example 2—Affixing Proxy Cork

A commercially-available proxy cork similar in appearance to proxy cork 60 in FIG. 2 is slid onto dispensing chamber 20 at receiving end 30 of liquid dispenser 10 formed in Example 1. The proxy cork comprises polyethylene, and the discs 62, 64, 66, and 68 are flexible enough to sealingly engage the inside surface of a neck of a bottle.

Example 3—Dispensing Liquid

The liquid dispenser with the proxy cork as assembled in Example 2 are affixed in the neck of a bottle of vermouth. When the bottle is tilted, the proxy cork holds the liquid dispenser in the neck of the bottle, and no liquid leaks out around the proxy cork. Vermouth enters the receiving portal and at least partially fills the dispensing chamber. Vermouth emerges from the dispensing portal one drop at a time. Six drops of vermouth are added to a cocktail shaker, and a precisely-made dry martini emerges.

EMBODIMENTS

Embodiment 1. A liquid dispenser for a bottle, comprising: a dispensing chamber having a receiving end opposite a dispensing end, the receiving end comprising a receiving portal, and the dispensing end comprising a dispensing portal.

Embodiment 2. The liquid dispenser of embodiment 1, wherein the dispensing portal is smaller in at least one dimension, relative to the receiving portal.

Embodiment 3. The liquid dispenser of any one of embodiments 1-2, wherein the dispensing portal is circular.

Embodiment 4. The liquid dispenser of any one of embodiments 1-3, wherein the receiving portal is circular.

Embodiment 5. The liquid dispenser of any one of embodiments 3-4, wherein the dispensing portal has a diameter of at least 0.1 mm, at least 0.2 mm, at least 0.3 mm, at least 0.4 mm, at least 0.5 mm, at least 0.6 mm, at least 0.7 mm, at least 0.8 mm, at least 0.9 mm, or at least 1.0 mm.

Embodiment 6. The liquid dispenser of any one of embodiments 3-4, wherein the dispensing portal has a diameter of no more than 1.0 mm, no more than 1.5 mm, no more than 2.0 mm, no more than 2.5 mm, no more than 3.0 mm, no more than 3.5 mm, no more than 4.0 mm, no more than 4.5 mm, or no more than 5.0 mm.

Embodiment 7. The liquid dispenser of any one of embodiments 3-6, wherein the receiving portal has a diameter of at least 0.15 mm, at least 0.2 mm, at least 0.3 mm, at least 0.4 mm, at least 0.5 mm, at least 0.6 mm, at least 0.7 mm, at least 0.8 mm, at least 0.9 mm, at least 1.0 mm, at least 1.1 mm, at least 1.2 mm, at least 1.3 mm, at least 1.4 mm, or at least 1.5 mm.

Embodiment 8. The liquid dispenser of any one of embodiments 3-6, wherein the receiving portal has a diameter of no more than 1.0 mm, no more than 1.5 mm, no more than 2.0 mm, no more than 2.5 mm, no more than 3.0 mm, no more than 3.5 mm, no more than 4.0 mm, no more than 4.5 mm, or no more than 5.0 mm.

Embodiment 9. The liquid dispenser of any one of embodiments 1-8, wherein the dispensing chamber comprises an arcuate cylindrical shape.

Embodiment 10. The liquid dispenser of any one of embodiments 1-9, further comprising a bottle cap portion supporting the dispensing chamber, the bottle cap portion adapted to maintain the liquid dispenser in a neck of the bottle.

Embodiment 11. The liquid dispenser of any one of embodiments 1-10, wherein the receiving end is adapted to engage a proxy cork that can sealingly engage a neck of the bottle.

Embodiment 12. The liquid dispenser of any one of embodiments 1-10, further comprising a proxy cork portion proximal to the receiving end, wherein the proxy cork portion is adapted to sealingly engage a neck of the bottle.

Embodiment 13. The liquid dispenser of any one of embodiments 1-12, further comprising a drip catcher on the dispensing end proximal to the dispensing portal.

Embodiment 14. The liquid dispenser of any one of embodiments 1-13, wherein the dispensing chamber comprises polyethylene, polypropylene, polyurethane, polyetheretherketone (PEEK), polystyrene, polytetrafluoroethylene, glass, stainless steel, aluminum, or a combination thereof.

Embodiment 15. The liquid dispenser of any one of embodiments 1-14, wherein the dispensing chamber further comprises a supporting fin.

Embodiment 16. The liquid dispenser of any one of embodiments 1-15, wherein the ratio of the thickness of the dispensing end to a width of the dispensing portal ranges from 0.1 to 10.

Embodiment 17. The liquid dispenser of embodiment 16, wherein the ratio is chosen from 0.1, 0.5, 1, 2, 3, 4, 5, and 10.

Embodiment 18. The liquid dispenser of any one of embodiments 1-17, wherein the dispensing portal has the geometry of a right cylinder, a rectangle, a pyramid, or a cone.

Embodiment 19. The liquid dispenser of any one of embodiments 1-18, wherein the dispensing end comprises a flat surface, a concave surface, a convex surface, or a combination thereof.

Embodiment 20. The liquid dispenser of any one of embodiments 1-19, wherein the dispensing chamber further comprises a ridge adapted to accommodate a proxy cork.

Embodiment 21. A method of making a liquid dispenser for a bottle, comprising:

constructing a dispensing chamber comprising a receiving end opposite a dispensing end;

establishing a receiving portal in the receiving end; and establishing a dispensing portal in the dispensing end.

Embodiment 22. The method of embodiment 21, wherein the constructing comprises blow molding, injection molding, extrusion molding, or a combination thereof.

Embodiment 23. The method of any one of embodiments 21-22, wherein the establishing a receiving portal comprises drilling the receiving end.

Embodiment 24. The method of any one of embodiments 21-23, wherein the establishing a dispensing portal comprises drilling the dispensing end.

Embodiment 25. The method of any one of embodiments 21-24, wherein the liquid dispenser is the liquid dispenser of any one of embodiments 1-20.

Embodiment 26. A method of dispensing a liquid from a bottle, comprising:

obtaining a liquid dispenser comprising a dispensing chamber having a receiving end opposite a dispensing end, wherein the receiving end comprises a receiving portal, and the dispensing end comprises a dispensing portal;

introducing the liquid to be dispensed into the dispensing chamber through the receiving portal; and dispensing the liquid from the dispensing chamber through the dispensing portal, wherein the liquid emerging from the dispensing portal is in the form of drops.

Embodiment 27. The method of embodiment 26, wherein the liquid dispenser is the liquid dispenser of any one of embodiments 1-20.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

We claim:

1. A method of making a liquid dispenser for a bottle, comprising:

constructing an enclosed, hollow dispensing chamber comprising a receiving end wall opposite a dispensing end wall along a cylindrical curved tube;

the receiving end wall, the dispensing end wall, and the cylindrical curved tube enclosing the dispensing chamber;

the dispensing chamber having a volume of at least 1 mL;

establishing a receiving portal in the receiving end wall; and establishing a dispensing portal in the dispensing end wall;

wherein the receiving portal is no larger than the dispensing end wall;

wherein the dispensing end wall has a thickness greater than a width of the dispensing portal; and wherein the liquid dispenser comprises no structure other than the dispensing chamber for equilibrating pressure.

2. The method of claim 1, wherein the constructing comprises blow molding, injection molding, extrusion molding, or a combination thereof.

3. The method of claim 1, wherein the establishing a receiving portal comprises drilling the receiving end wall.

4. The method of claim 1, wherein the establishing a dispensing portal comprises drilling the dispensing end wall.

5. The method of claim 1, wherein the dispensing chamber has a volume less than 2 mL.

6. The method of claim 1, wherein the constructing comprises glassblowing, glass molding, or a combination thereof.

7. The method of claim 1, wherein the constructing comprises casting, milling, welding, or a combination thereof.

* * * * *